US008534823B2

(12) United States Patent
Toya et al.

(10) Patent No.: US 8,534,823 B2
(45) Date of Patent: Sep. 17, 2013

(54) RECORDING APPARATUS WITH UNIFORM DRYING UNIT

(75) Inventors: Akihiro Toya, Suwa (JP); Shinji Kawakami, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 205 days.

(21) Appl. No.: 12/868,840

(22) Filed: Aug. 26, 2010

(65) Prior Publication Data

US 2011/0050823 A1 Mar. 3, 2011

(30) Foreign Application Priority Data

Aug. 27, 2009 (JP) ..... 2009-196443

(51) Int. Cl.
*B41J 2/01* (2006.01)

(52) U.S. Cl.
USPC ..... 347/102

(58) Field of Classification Search
None
See application file for complete search history.

(56) References Cited

U.S. PATENT DOCUMENTS

2007/0172285 A1* 7/2007 Izawa et al. ..... 400/188
2008/0158324 A1* 7/2008 Yraceburu et al. ..... 347/102
2008/0213706 A1* 9/2008 Hackler et al. ..... 430/327

FOREIGN PATENT DOCUMENTS

JP 2009-073012 4/2009
JP 2009073012 A * 4/2009

* cited by examiner

*Primary Examiner* — Geoffrey Mruk
*Assistant Examiner* — Bradley Thies
(74) *Attorney, Agent, or Firm* — Workman Nydegger

(57) ABSTRACT

A recording apparatus includes a transport unit that intermittently transports an elongated recording medium from an upstream side to a downstream side as the lengthwise direction of the recording medium moves along a transport path. A recording unit adheres a recording material to the recording medium when the recording medium is stopped in a midstream position of the transport path. A drying unit downstream from the recording unit heats and dries the recording material. A contact member has a contact surface continuous contact with the surface of the recording medium opposite the surface thereof to which the recording material is adhered, from the time when the recording medium enters into the drying unit to the time when the recording medium is discharged from the drying unit. The contact member forms the transport path with the contact surface having at least one bent section in the drying unit.

10 Claims, 5 Drawing Sheets

RECORDING APPARATUS WITH UNIFORM DRYING UNIT

The entire disclosure of Japanese Patent Application No. 2009-196443 filed Aug. 27, 2009 is expressly incorporated by reference in its entirety herein.

BACKGROUND

1. Technical Field

The present invention relates to a recording apparatus such as an ink jet printer.

2. Related Art

In the related art, there is well known an ink jet printer (hereinafter, referred to as a "printer") as a kind of a recording apparatus in which a recording material is adhered to a target to perform recording. Recently, there has been proposed a technology in which a liquid (recording material) is ejected to a continuous recording medium (target) using such a printer to continuously print a plurality of unit images which will be used as labels by being cut later. (For example, refer to JP-A-2009-73012.)

That is, in the printer as disclosed in JP-A-2009-73012, a platen is installed in a midstream position of a transport path of a continuous recording medium, and ink (recording material) is ejected onto the continuous recording medium in the state of being stopped in transporting on the platen to perform printing. Then, an ink printed image formed on the continuous recording medium is heated and forcibly dried in a forcible drying section which is installed in the vicinity of the downstream side of the platen in the transport path of the continuous recording medium. Thereafter, the continuous recording medium of which the ink printed image is forcibly dried by the forcible drying section is rolled by a roll driving shaft installed on a further downstream side of the forcible drying section in the transport path of the continuous recording medium. In this respect, a region of the platen on which the printing is performed with respect to the continuous recording medium becomes a printing region, and the continuous recording medium is intermittently transported along the transport path in the unit of the printing region.

In the printer as disclosed in JP-A-2009-73012, a take-up roller for taking-up the continuous recording medium is installed in the forcible drying section. The take-up roller bends the transport path of the continuous recording medium in the forcible drying section to increase a transport distance of the continuous recording medium. As a result, the time for which the ink ejected onto the continuous recording medium is fixed in the forcible drying section is lengthened, and thus, the ink ejected onto the continuous recording medium can be sufficiently fixed.

However, in the printer as disclosed in JP-A-2009-73012, the take-up roller locally comes in contact with the surface opposite to the surface of the continuous recording medium onto which the ink is ejected. Thus, when the take-up roller is heated in the forcible drying section, the continuous recording medium is locally heated by the take-up roller at a part thereof which comes in contact with the heated take-up roller. Accordingly, the continuous recording medium is overheated by the take-up roller in the process of passing through the forcible drying section at a part thereof which comes in contact with the take-up roller in the state of being stopped in transporting, and thus, the unevenness may occur in the drying.

SUMMARY

An advantage of some aspects of the invention is that it provides a recording apparatus which is capable of uniformly heating and fixing a recording material adhered to a target.

According to a first aspect of the present invention, there is provided a recording apparatus including: a transport unit which intermittently transports a recording medium of a long shape from the upstream side to the downstream side so that the lengthwise direction of the recording medium moves along a transport path; a recording unit which adheres a recording material to the recording medium in the state of being stopped in transporting in a midstream position of the transport path to perform recording; a drying unit which is installed on the downstream side position of the recording unit in the transport path to heat and dry the recording material; and a contact member which includes a contact surface being in continuous contact with the surface of the recording medium opposite to the surface thereof to which the recording material is adhered, from the time when the recording medium enters into the drying unit to the time when the recording medium is discharged from the drying unit, and is configured to form the transport path with the contact surface having at least one bent section in the drying unit.

With such a configuration, the contact member forms the bent section in the midstream position of the transport path of the recording medium in the drying unit, and increases a transport distance of the recording medium in the drying unit. Thus, the recording medium is configured so that the recording material adhered to the recording medium by means of the recording unit can be sufficiently heated and fixed in the process of passing through the drying unit. In this respect, even though the contact member is heated in the drying unit, the heated contact member comes in continuous contact with the entire region of the recording medium in the state of being stopped in transporting in the drying unit through the contact surface thereof. Thus, the contact member uniformly heats the surface of the recording medium opposite to the surface thereof to which the recording material is adhered, through the contact surface thereof in the process in which the recording medium passes through the drying unit, and thus, the recording material adhered to the recording medium can be uniformly dried.

In the above described recording apparatus, the contact member may be configured so that the thermal capacity of a region thereof which is arranged in the drying unit becomes uniform.

With such a configuration, in a case where the contact member is heated in the drying unit, since temperature of the contact surface being in contact with the recording medium in the drying unit becomes uniform, it is possible to uniformly heat and dry the recording material adhered to the recording medium through the contact surface.

In the above described recording apparatus, the contact surface of the contact member may be formed by performing a bending process for a single material.

With such a configuration, since the contact member comes in contact with the recording medium to be continuous along the transport direction of the recording medium without intermittence, it is possible to uniformly heat and dry the recording material adhered to the recording medium.

In the above described recording apparatus, the contact member may be formed of a metallic material.

With such a configuration, since the contact member is made of a metallic material having a high level of heat conductivity, it is possible to shorten time required when the contact member is preheated up to the same temperature as in the inside of the drying unit, when the recording apparatus starts its operation.

The above described recording apparatus further includes a blowing unit which blows warm air towards the surface of the recording medium to which the recording material is adhered in the drying unit.

With such a configuration, the blowing unit can reliably dry the recording material adhered to the recording medium by blowing the warm air towards the recording material adhered to the recording medium in the drying unit.

In the above described recording apparatus, the contact surface of the contact member is formed by a smoothing process.

With such a configuration, since the contact member is configured so that the sliding resistance of the contact surface being in contact with the recording medium becomes small, it is possible to restrict the recording medium from being abraded in the process of sliding on the contact surface of the contact member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink jet printer (hereinafter, referred to as a "printer") according to a specific embodiment of the present invention will be described with reference to FIGS. 1A to 3. In this description, the terms of a "front and rear direction", a "left and right direction" and an "up and down direction" are used to represent directions indicated by arrows in FIG. 1A.

Figure 1A:
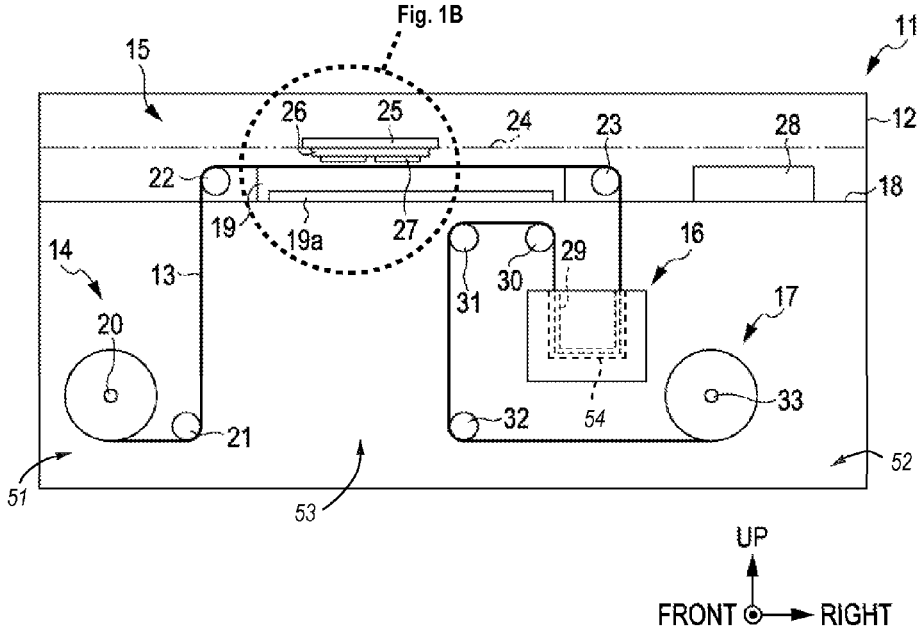
FIGS. 1A and 1B are diagrams illustrating a schematic configuration of a recording apparatus according to an embodiment of the present invention.
Figure 1B:
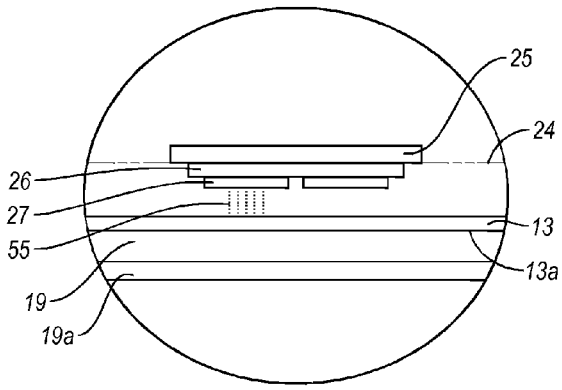

As shown in FIGS. 1A and 1B, the printer 11 which is a recording apparatus includes a main body case 12 having a rectangular parallelepiped shape. In the main body case 12 are installed a reeling out section 14 which reels out a continuous recording medium 13 as a recording medium having an elongated shape, a printing chamber 15 in which ink as a recording material 55, illustrated in FIG. 1B, is ejected onto the continuous recording medium 13 to perform printing, a drying device 16 as a drying unit which performs a drying process with respect to the continuous recording medium 13 to which the ink is adhered by the printing, and a rolling section 17 which rolls the continuous recording medium 13 which has undergone the drying process.

That is, a base 18 of a plate shape is installed in a position which is located slightly above a central section of the main body case 12 in the up and down direction so as to partition the inside of the main body case 12 in the up and down direction. A space above the base 18 serves as the printing chamber 15 in which a platen 19 of a rectangular plate shape is supported on the base 18. In a space under the base 18, the reeling out section 14 is installed at the left side position which is the upstream side 51 in the transport direction of the continuous recording medium 13, and the drying device 16 and the rolling section 17 are installed at the right side position which is the downstream side 52 therein.

As shown in FIGS. 1A and 1B, a rolling shaft 20 extending in the front and rear direction is installed in the reeling out section 14 to be able to rotate, and the continuous recording medium 13 is supported to be able to integrally rotate with the rolling shaft 20 in a state where the continuous recording medium 13 is rolled in advance in a roll shape with respect to the rolling shaft 20. That is, as the rolling shaft 20 rotates, the continuous recording medium 13 is supplied from the reeling out section 14 to be transported on a downstream side of the transport direction. Further, on the right side of the reeling out section 14, a first roller 21 which is configured to take up the continuous recording medium 13 continuously supplied from the rolling shaft 20 from the lower right side so as to change the transport direction of the continuous recording medium 13 in the vertical up direction is provided to be extended in the front and rear direction in a state where the first roller 21 is in parallel with the rolling shaft 20.

On the other hand, in the printing chamber 15, in a position which is the left side of the platen 19 and corresponds to the lower side first roller 21 in the up and down direction, a second roller 22 is provided to be extended in the front and rear direction in a state where the second roller 22 is in parallel with the lower side first roller 21. Further, the continuous recording medium 13 of which the transport direction changes to the vertical up direction by the first roller 21 is taken-up from the lower left side in the second roller 22, and thus, the transport direction changes in the horizontal right direction to slide on an upper surface of the platen 19.

Further, on the right side of the platen 19 in the printing chamber 15, a third roller 23 which faces the left side second roller 22 in the left and right direction, with the platen 19 being interposed therebetween, is provided to be extended in the front and rear direction in a state where the third roller 23 is in parallel with the second roller 22. Further, each installation position of the second roller 22 and the third roller 23 is adjusted so that each circumferential top section thereof has the same height as the upper surface of the platen 19. Thus, the continuous recording medium 13 of which the transport direction is changed in the horizontal right direction by the second roller 22 located on the left side in the printing chamber 15 is transported on the right side which is the downstream side while being slid on the upper surface of the platen 19. A platen heater 19*a* is installed in the platen 19, and is configured to heat the continuous recording medium 13 supported on the upper support surface of the platen 19.

Further, in the front and rear sides of the platen 19 in the printing chamber 15, a guide rail 24 (indicated by a two dotted dashed line in FIGS. 1A and 1B) which is extended in the left and right direction is installed to make a pair. The upper surface of the guide rail 24 is higher than the upper surface of the platen 19, and a rectangular carriage 25 is supported on upper surfaces of both the guide rails 24 in a state where the rectangular carriage 25 can reciprocatingly move in the left and right direction along the guide rails 24, by the driving power of a driving mechanism (not shown). Further, a recording head 27 which is a recording means is supported through a support plate 26 on a lower surface side of the carriage 25.

In the printing chamber 15, a certain range on the platen 19 which ranges from a left edge thereof to a right edge thereof becomes a printing region, and the continuous recording medium 13 is configured to be intermittently transported in the unit of the printing region. Further, as ink is ejected from the recording head 27 in accordance with the reciprocating movement of the carriage 25 with respect to the continuous recording medium 13 in the state of being stopped on the platen 19 by the intermittent transport in the printing region unit, the printing with respect to the continuous recording medium 13 is performed. Further, in the printing chamber 15, in a non-printing region which becomes the right side with respect to the third roller 23, a maintenance mechanism 28 for performing maintenance of the recording head 27 at the time of non-printing is installed.

Further, the continuous recording medium 13 on which the printing is performed in the printing chamber 15 is taken-up on the upper right side by the third roller 23, and thus, the transport direction thereof is changed in the vertical down direction to be transported toward the drying device 16 which is located under the base 18. Further, the continuous recording medium 13 passes through the drying device 16 while the transport direction thereof is being guided by a guide member 29 as a contact member, and thus, a drying process is performed with respect to the printing surface in which the printing is performed in the printing chamber 15. Further, the continuous recording medium 13 which is discharged from the drying device 16 in the vertical up direction is sequentially taken-up on a fourth roller 30, a fifth roller 31 and a sixth roller 32 to change the transport direction thereof, and then is transported toward the rolling section 17 which is located on the right side of the sixth roller 32.

In the rolling section 17, a rolling shaft 33 which is a transport means which is configured to extend in the front and rear direction in the state of being in parallel with the sixth roller 32 is installed, and the leading edge which becomes the downstream edge of the transport direction of the recording medium 13 is rolled on the rolling shaft 33. Further, the rolling section 33 is driven to rotate by the driving power of a transport motor (not shown), and thus, the continuous recording medium 13 is sequentially rolled to the rolling shaft 33.

Next, a configuration of the drying device 16 will be described.

Figure 2:
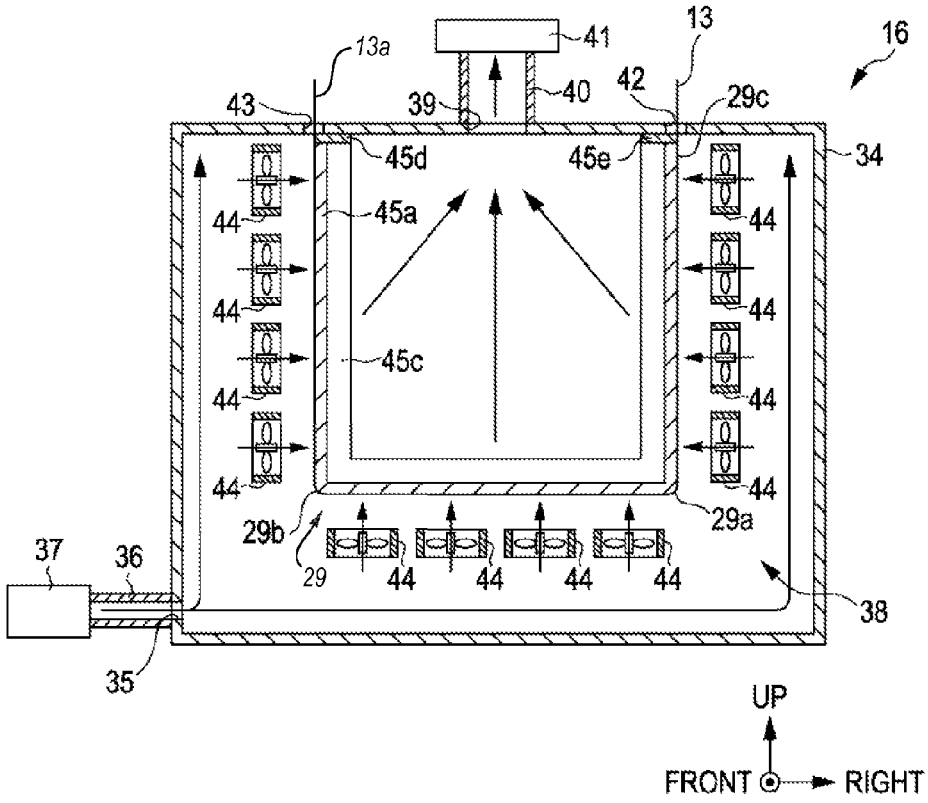
FIG. 2 is a sectional view illustrating a drying device according to an embodiment of the present invention.

As shown in FIG. 2, the drying device 16 includes a casing 34 in the shape of a box having an empty inside. An air supply opening 35 is formed in a lower part of a left side wall section of the casing 34, and a warm air blowing mechanism 37 is connected to the air supply opening 35 through an air supply duct 36. Further, the warm air blowing mechanism 37 is configured to heat an internal space 38 of the casing 34 by the warm air supplied inside the casing 34 through the air supply duct 36.

Further, an air discharge opening 39 is formed approximately in a central part of a top wall section of the casing 34, and an air discharge fan 41 is connected to the air discharge opening 39 through an air discharge duct 40. Further, air heated by the warm air in the internal space 38 of the casing 34 is discharged outside the casing 34 through the air discharge duct 40, in accordance with driving of the air discharge fan 41. That is, the flow of the heated air is generated in the internal space 38 of the casing 34.

Further, in the top wall section of the casing 34, a pair of left and right through openings 42 and 43 is formed to be separated from each other with the air discharge opening 39 being interposed therebetween. Further, the through openings 42 and 43 are formed so that the width of the through openings 42 and 43 in the front and rear direction become larger than the width of the continuous recording medium 13 in the front and rear direction, to thereby allow the continuous recording medium 13 to pass therethrough.

Further, in the casing 34, the guide member 29 having an approximate U shape when seen from a front view is installed to be connected with the top wall part of the casing 34 so that a pair of left and right upper end parts of the guide member 29 aligned with the through openings 42 and 43. Further, the guide member 29 includes two bent sections 29*a* and 29*b* which are bent approximately at a right angle at the left and right lower end parts of the guide member 29, a surface 29*c* (surface which becomes a convex surface directing downwards in FIG. 2) which becomes a contact surface for sliding the continuous recording medium 13 is configured to form an approximate U shape when seen from a front view thereof from the through opening 42 located on the upper right side to the through opening 43 located on the upper left side, through the bent section 29*a* located on the lower right side and the bent section 29*b* located on the lower left side. Since the surface 29*c* of the guide member 29 forms a curved surface in the bent sections 29*a* and 29*b*, the transport direction of the continuous recording medium 13 is smoothly changed in the bent sections 29*a* and 29*b*.

Further, in the casing 34, a plurality (12 in this embodiment) of axial fans 44 which are blowing members is arranged so that the axial fans 44 are disposed in parallel along the surface 29*c* of the guide member 29 which forms the transport path of the continuous recording medium 13 in the casing 34, and so that each blowing direction thereof becomes approximately vertical with respect to the printing surface of the continuous recording medium 13 moving along the surface 29*c* of the guide member 29. Further, the axial fans 44 are configured to blow the air inside the casing 34 heated by the warm air blowing mechanism 37 as the warm air toward the printing surface of the continuous recording medium 13, to thereby facilitate the drying of the printing surface of the continuous recording medium 13 in the internal space 38 of the casing 34.

Further, the transport path at the time when the continuous recording medium 13 passes the internal space 38 of the casing 34 is bent in an approximate U shape to be suitable for a shape of the surface 29*c* of the guide member 29, to thereby increase the transport distance thereof. Thus, the printing surface of the continuous recording medium 13 is sufficiently heated in the process of passing through the internal space 38 of the casing 34 to be fixed to the continuous recording medium 13. Further, the length of the transport path of the continuous recording medium 13 in the internal space 38 of the casing 34 is set to correspond to the length of the printing region in the left and right direction which becomes the intermittent transport unit of the continuous recording medium 13. Thus, the printing surface of the continuous recording medium 13 can secure a uniform drying time in the printing region unit in conjunction with the intermittent printing and transport.

Figure 3:
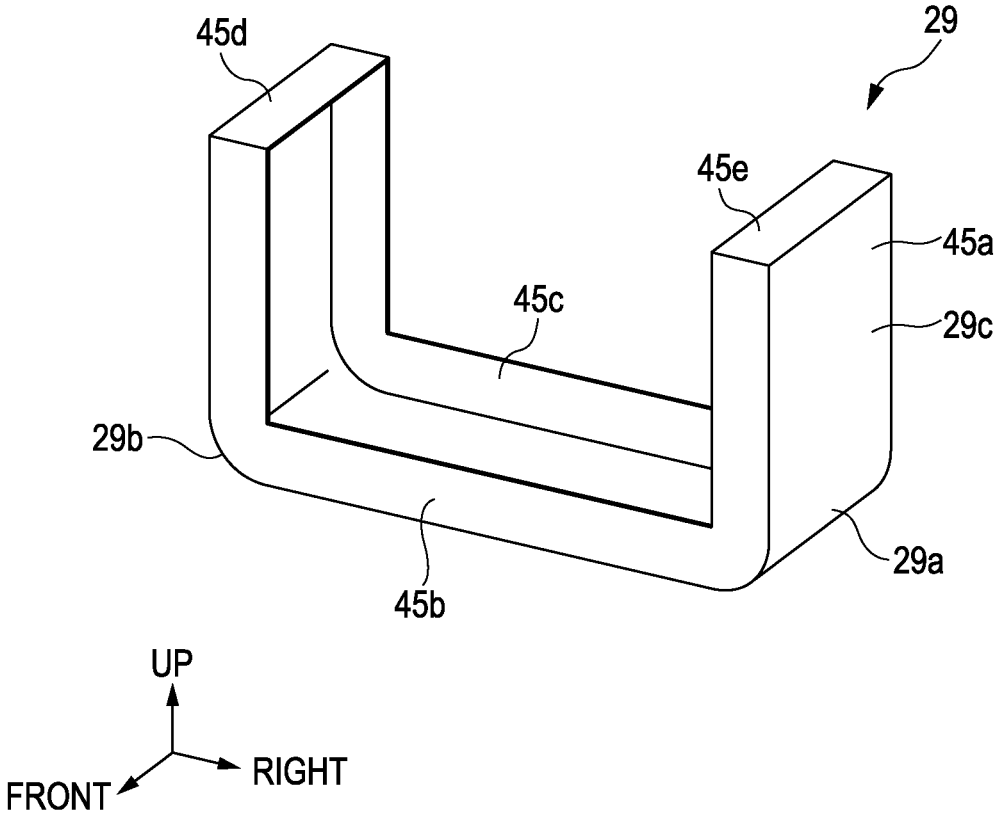
FIG. 3 is a perspective view illustrating a guide member according to an embodiment of the present invention.

Next, a configuration of the guide member 29 will be described. As shown in FIG. 3, the guide member 29 has a configuration in which a plurality (5 in this embodiment) of plate members 45*a*, 45*b*, 45*c*, 45*d* and 45*e* made of a metallic material is bonded with each other. That is, the guide member 29 includes the guide plate member 45*a* of an approximate U shape when seen from a front view, which is formed by bending two portions of the metallic material of a band shape in a lengthwise direction thereof; the front and rear pair of reinforcing plate members 45*b* and 45*c* which is welded on the front and rear edges of the guide plate member 45*a*; and the left and right pair of connection plate members 45*d* and 45*e* which is welded on each upper edge of the guide plate member 45*a* and the reinforcing plate members 45*b* and 45*c*.

The guide member 29 is configured so that the surface 29*c* which becomes the contact surface on which the continuous recording medium 13 is slid is formed of the single guide plate member 45*a*. Thus, the guide member 29 is configured to be bent in an approximate U shape in a state where the contact surface on which the continuous recording medium 13 is slid is continuous without intermittence along the transport direction of the continuous recording medium 13. Further, the guide plate member 45*a* for forming the surface 29*c* (contact surface with respect to the continuous recording medium 13) of the guide member 29 has a uniform thickness in the entire surface region of the guide plate member 45*a*. Accordingly, the guide member 29 has a uniform thermal capacity in the entire region along the transport path of the continuous recording medium 13. Further, the surface 29*c* of the guide member 29 is configured so that a buffing process is performed as a smoothing process and thus the sliding resistance with respect to the continuous recording medium 13 becomes remarkably small. In this embodiment, aluminum materials having a high level of heat conductivity are used as the materials of the respective plate members 45*a*, 45*b*, 45*c*, 45*d*, and 45*e* for forming the guide member 29.

Next, an operation of the printer 11 having the above described configuration, and in particular, an operation at the time when the printing surface of the continuous recording medium 13 is heated and dried in the process of passing through the drying device 16 will be described hereinafter.

Right after starting the operation of the printer 11, firstly, the drying device 16 operates the warm air blowing mechanism 37, to thereby blow the warm air into the internal space 38 of the casing 34 from the warm air blowing mechanism 37. Then, the air contained in the internal space 38 of the casing 34 is heated and is gradually increased in temperature. At this time, as the air in the internal space 38 of the casing 34 is heated, the guide member 29 is heated until the temperature thereof becomes nearly the same temperature as in the internal space 38 of the casing 34 by the heated air.

Subsequently, at a point of time when the temperature of the guide member 29 is stabilized, the transport motor is driven to rotate the rolling shaft 33. Then, in accordance with the rotational driving of the rolling shaft 33, the leading edge which becomes the downstream edge of the recording medium 13 in the transport direction is sequentially rolled on the rolling shaft 33. Further, the recording medium 13 on which the printing is performed in the printing chamber 15 enters into the internal space 38 of the casing 34 through the right through opening 42 among the pair of through openings 42 and 43 which is formed in the top wall section of the casing 34 of the drying device 16, in a state where the printing surface of the recording medium 13 to which the ink is ejected is directed to the right side.

In this respect, the continuous recording medium 13 which has entered into the internal space 38 of the casing 34 passes through the internal space 38 of the casing 34 in a state where the rear surface of the printing surface to which ink is adhered is in contact with the surface 29*c* of the guide member 29. Accordingly, the continuous recording medium 13 is heated from the rear surface of the printing surface through the surface 29*c* of the guide member 29 having nearly the same temperature as in the internal space 38 of the casing 34.

In this respect, the continuous recording medium 13 which has entered into the internal space 38 of the casing 34 comes in continuous contact with the surface 29*c* of the guide member 29 along the transport direction of the continuous recording medium 13 without intermittence. Thus, the continuous recording medium 13 is uniformly heated through the surface 29*c* of the guide member 29 in the process of passing through the internal space 38 of the casing 34, even though the continuous recording medium 13 is intermittently transported.

Further, on the printing surface of the continuous recording medium 13, from the axial fans 44, the air heated in the internal space 38 of the casing 34 is blown in an approximately vertical direction. Then, the printing surface of the continuous recording medium 13 is heated by the warm air blown from the axial fans 44, and an ink vapor layer and an ink solvent vapor layer floating on the printing surface of the continuous recording medium 13 are appropriately removed from the printing surface of the continuous recording medium 13.

Further, the air blown to the printing surface of the continuous recording medium 13 from the axial fans 44 enters into a space region of the rear surface side of the contact surface (the surface 29*c*) with respect to the continuous recording medium 13 in the guide member 29. Further, the air is rapidly discharged from the internal space 38 of the casing 34 through the air discharge duct 40 in the state of including lots of ink and ink solvents removed from the printing surface of the continuous recording medium 13. Accordingly, even in the case where the drying device 16 is operated for a long time, the ink and ink solvents volatilized from the printing surface of the continuous recording medium 13 hardly stay in the internal space 38 of the casing 34.

Thereafter, the continuous recording medium 13 is transported outside the casing 34 through the through opening 43 located on the left side among the pair of through openings 42 and 43 installed in the top wall part of the casing 34 of the drying device 16. Further, in a state where the printing surface of the recording medium 13 is fixed in the process of passing through the internal space 38 of the casing 34, the continuous recording medium 13 is rolled on the rolling shaft 33.

According to the present embodiment, the following effects can be achieved.

(1) In the above described embodiment, the guide member 29 is configured so that the bent sections 29*a* and 29*b* are formed in the midstream position 53 of the transport path 54 of the continuous recording medium 13 in the internal space 38 of the casing 34 so as to increase the transport distance of the continuous recording medium 13 in the internal space 38 of the casing 34. Thus, the continuous recording medium 13 is configured so that the ink ejected from the recording head 27 is sufficiently heated and fixed in the process of passing through the internal space 38 of the casing 34. Further, even in the case where the guide member 29 is heated in the internal space 38 of the casing 34, the heated guide member 29 comes in continuous contact with the entire region of the continuous recording medium 13 in the state of being stopped in transporting in the internal space 38 of the casing 34 through the contact surface (surface 29*c* of the guide member 29). Accordingly, in the process where the continuous recording medium 13 passes through the internal space 38 of the casing 34, the guide member 29 uniformly heats the surface 13*a* of the continuous recording medium 13 of the surface thereof to which the ink is ejected through the contact surface (surface 29*c* of the guide member 29), and thus, the ink ejected onto the continuous recording medium 13 can be uniformly dried.

(2) In the above described embodiment, the guide member 29 is configured so that the guide plate member 45*a* for forming the contact surface with respect to the continuous recording medium 13 has the uniform thermal capacity in each region along the transport path of the continuous recording medium 13. Thus, each region along the transport path in the continuous recording medium 13 receives nearly a uniform heat amount through the guide plate member 45*a* in the process of passing through the internal space 38 of the casing 34, while sliding on the contact surface formed of the surface 29*c* of the guide member 29. Accordingly, the uneven drying can be prevented from being generated in the process where the printing surface of the continuous recording medium 13 passes through the internal space 38 of the casing 34.

(3) In the above described embodiment, the guide member 29 is configured so that the guide plate member 45*a* for forming the contact surface (surface 29*c*) with respect to the continuous recording medium 13 is formed of the aluminum materials having the high level of heat conductivity and is formed of a metallic plate molded in a thin plate shape so as to reduce the thermal capacity. Thus, the guide member 29 can reduce the required time until the contact surface (surface 29*c*) with respect to the continuous recording medium 13 is heated to become nearly the same temperature as in the internal space 38 of the casing 34 so as to stabilize the temperature thereof.

(4) In the above described embodiment, the guide member 29 is configured so that the guide plate member 45*a* for forming the contact surface (surface 29*c*) with respect to the continuous recording medium 13 has a reinforced stiffness by the reinforcing plate members 45*b* and 45*c*. Thus, in the process where the continuous recording medium 13 slides on the contact surface (surface 29*c*) of the guide member 29, even though the guide member 29 receives the pressure from the side of the continuous recording medium 13, the contact surface (surface 29*c*) of the guide member 29 is prevented from being distorted and deformed, to thereby maintain the state of the continuous contact with the continuous recording medium 13.

(5) In the above described embodiment, the axial fans 44 blow the warm air toward the ink adhered to the continuous recording medium 13 in the internal space 38 of the casing 34, and thus, the ink adhered to the continuous recording medium 13 can be reliably dried.

(6) In the above described embodiment, since the guide member 29 is configured so that the sliding resistance of the contact surface (surface 29*c*) with respect to the continuous recording medium 13 is decreased, the continuous recording medium 13 can be prevented from being abraded in the process where the continuous recording medium 13 slides on the contact surface (surface 29*c*) of the guide member 29.

Hereinafter, modified embodiments of the above described embodiment will be described.

Figure 4A:
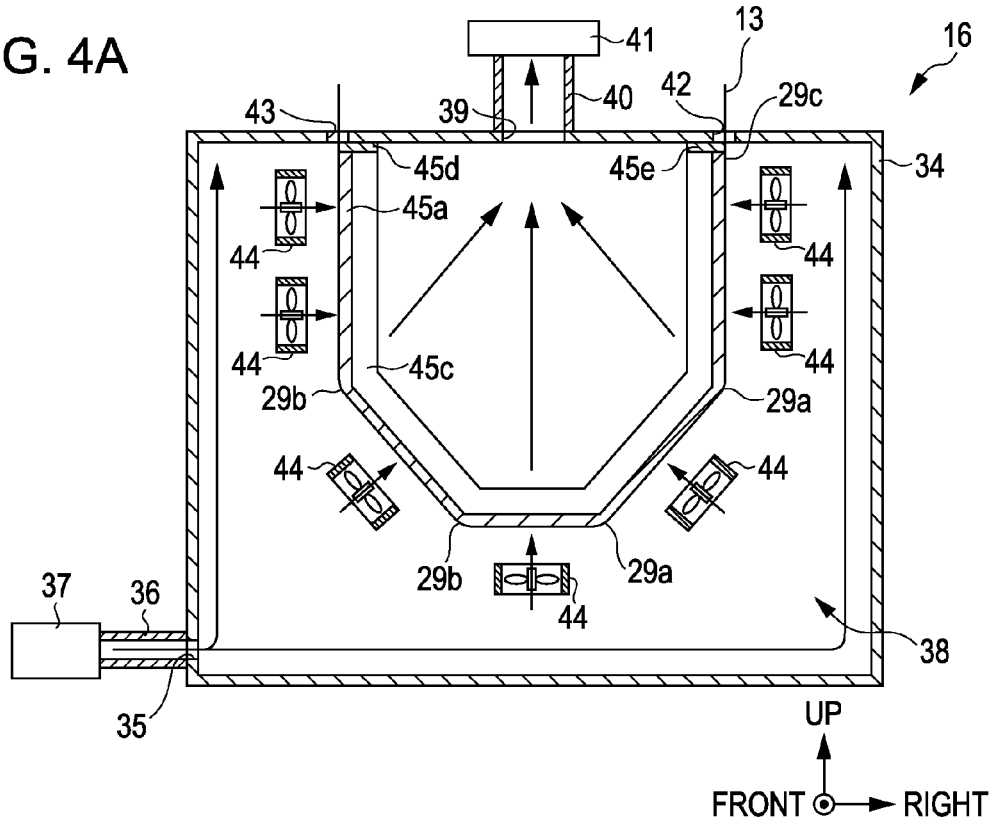
FIG. 4A is a sectional view illustrating a drying device according to another embodiment of the present invention.
Figure 4B:
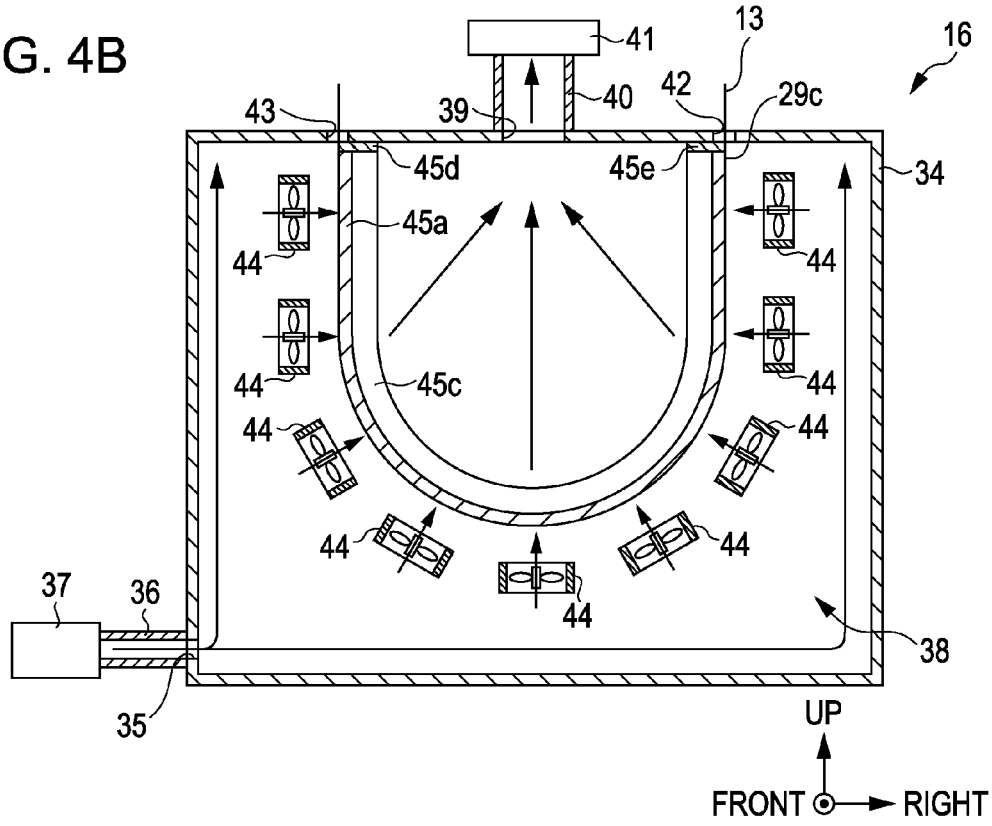
FIG. 4B is a sectional view illustrating a drying device according to another embodiment of the present invention.
Figure 5A:
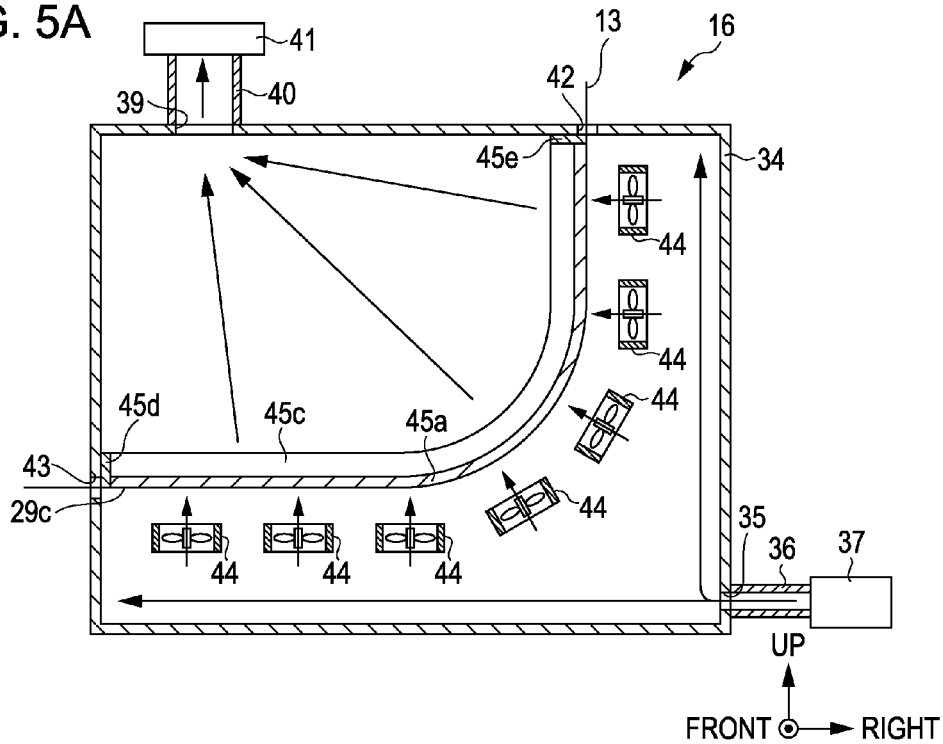
FIG. 5A is a sectional view illustrating a drying device according to another embodiment of the present invention.

In the above described embodiment, as shown in FIG. 4A, the guide member 29 may have an approximate U shape which is bent at an obtuse angle so as to have two bent sections 29*a* at a lower right part thereof and two bent sections 29*b* at a lower left part thereof. Further, as shown in FIG. 4B, the guide member 29 may be curved so as to have one large bent section of an approximate U shape in which a bent section at a lower right part thereof and a bent section at a lower left part thereof are continuously joined. In addition, as shown in FIG. 5A, through openings 42 and 43 may be respectively formed in the top wall section and the side wall section of the casing 34 of the drying device 16, and the guide member 29 may be smoothly curved approximately at a right angle so as to be connected with proximal sections of the through openings 42 and 43. That is, the guide member 29 may employ any configuration as long as the guide member 29 has at least one curved or bent section and the contact surface (surface 29*c*) thereof with respect to the continuous recording medium 13 has a continuous shape in the internal space 38 of the casing 34.

Figure 5B:
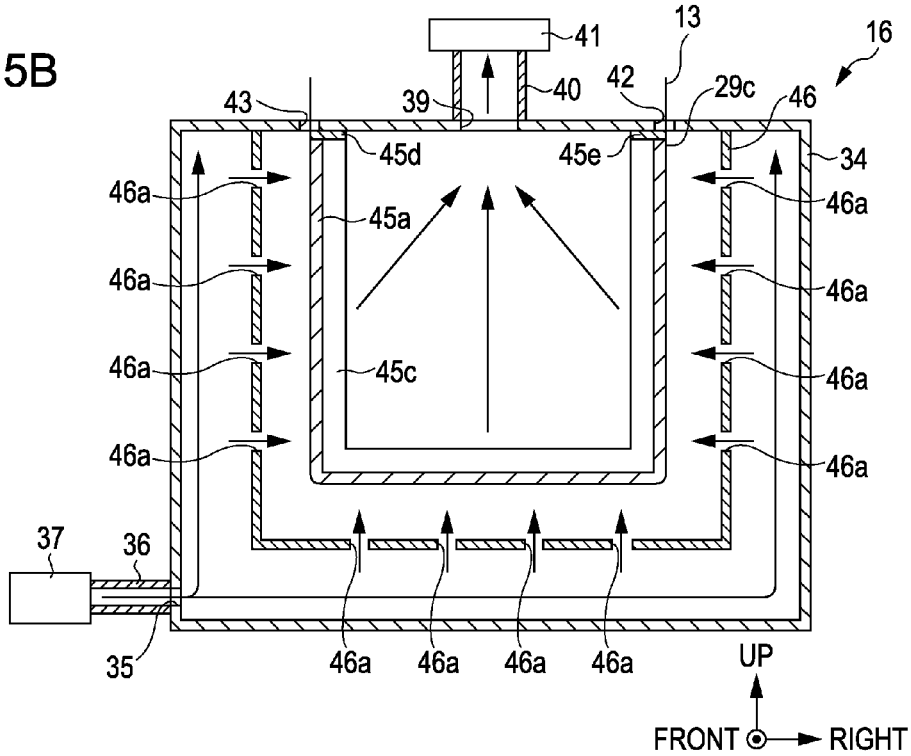
FIG. 5B is a sectional view illustrating a drying device according to another embodiment of the present invention.

In the above described embodiment, as shown in FIG. 5B, a slit plate 46 may be installed to face the contact surface (surface 29*c*) of the guide member 29. With such a configuration, since the air flow acts on the printing surface of the continuous recording medium 13 approximately at a vertical direction through slit holes 46*a* formed in the slit plate 46, it is possible to facilitate the drying of the printing surface of the continuous recording medium 13.

In the above described embodiment, the drying device 16 may have a configuration in which the warm air blown towards the continuous recording medium 13 is circulated in the internal space 38 of the casing 34. In this case, it is preferable that an adsorbing filter for adsorbing and collecting the ink and ink solvents volatilized from the printing surface of the continuous recording medium 13 may be installed in a midstream position of a flow path of the air flow circulated in the internal space 38 of the casing 34.

In the above described embodiment, the guide member 29 may be configured so that heaters for heating the guide plate member 45*a* from the rear surface of the contact surface (surface 29*c*) with respect to the continuous recording medium 13 are installed over the entire region along the transport path of the continuous recording medium 13 in the internal space 38 of the casing 34. According to such a configuration, since the guide plate member 45*a* is uniformly heated by the heater in each region along the transport path of the continuous recording medium 13, the printing surface of the continuous recording medium 13 can be uniformly heated and dried.

In the above described embodiment, the guide plate member 45*a* may be configured by connecting a plurality of plate members with each other by welding or the like.

In the above described embodiment, the guide member 29 may include the plate members 45*a*, 45*b*, 45*c*, 45*d* and 45*e* made of resin materials or the like. Here, it is preferable that the guide plate member 45*a* is formed of materials having a high level of heat conductivity so as to facilitate the drying by heating the printing surface of the continuous recording medium 13 in the process where the continuous recording medium 13 passes through the internal space 38 of the casing 34.

In the above described embodiment, the guide plate member 45*a* may be formed of materials of heat insulating properties. According to such a configuration, the guide plate member 45*a* is hardly heated in the internal space 38 of the casing 34. Accordingly, the continuous recording medium 13 is not heated by the guide plate member 45*a* in the process of passing through the internal space 38 of the casing 34, and the uneven drying can be prevented from being generated on the printing surface of the continuous recording medium 13.

In the above described embodiment, a moisture adsorbing filter may be installed in an air supply inlet of the axial fan 44. According to such a configuration, the axial fan 44 blows the dried warm air toward the printing surface of the continuous recording medium 13, and thus, the printing surface of the continuous recording medium 13 can be more rapidly dried.

In the above described embodiment, an elongated plastic film or the like may be used as the recording medium.

In the above described embodiment, the recording apparatus is embodied as the ink jet printer, but is not limited thereto. The recording apparatus may be embodied as a liquid ejection apparatus which is configured to eject or discharge a liquid other than ink (including a liquid material in which particles of a functional material are dispersed or mixed in a liquid, or a fluid material such as gel). For example, the recording apparatus may be embodied as a liquid ejection apparatus which is configured to eject a liquid (liquid material) which includes materials such as electrode materials or color materials (pixel materials) used for manufacturing liquid crystal displays, EL (electroluminescent) displays, surface emitting displays and so on, in a dispersed or solved form, as a liquid ejection apparatus which is configured to eject bioorganic materials used for manufacturing biochips, and a liquid ejection apparatus which is used as a precise pipette and is configured to eject liquids as specimens. Further, the recording apparatus may be embodied as a liquid ejection apparatus which is configured to eject lubricants with pinpoint accuracy to precision machines such as clocks or cameras, a liquid ejection apparatus which is configured to eject onto a substrate a transparent resin liquid such as an ultraviolet cured resin used for forming a micro-hemispherical lens (optical lens) or the like which is used in an optical communication element or the like, a liquid ejection apparatus which is configured to eject an etching liquid such as an acid or alkali for etching a substrate or the like, and a liquid ejection apparatus which is configured to eject a liquid (fluid material) such as a gel (for example, physical gel). That is, the present invention may be applied to any one type of liquid ejection apparatus, among these liquid ejection apparatuses.

What is claimed is:

1. A recording apparatus comprising:

a recording head which adheres a recording material to a continuous recording medium;

a support member which supports the recording medium;

a drying unit which is installed on a downstream side of the recording head in a transport path to heat and dry the recording material, wherein the recording medium enters into the drying unit intermittently, the drying unit including a first wall through which the transport path turns back; and a contact member which includes a contact surface being in continuous contact with a surface of the recording medium opposite to a surface thereof to which the recording material is adhered, from the time when the recording medium enters into the drying unit to the time when the recording medium is discharged from the drying unit, the contact member being configured to form the transport path with the contact surface having at least one bent section in the drying unit and the contact member being mounted to the first wall.

2. The recording apparatus according to claim 1, wherein the contact member is configured so that the thermal capacity of a region thereof which is arranged in the drying unit becomes uniform.

3. The recording apparatus according to claim 1, wherein the contact surface of the contact member is formed by performing a bending process for a single material.

4. The recording apparatus according to claim 1, wherein the contact member is formed of a metallic material.

5. The recording apparatus according to claim 1, further comprising a blowing unit which blows warm air towards the surface of the recording medium to which the recording material is adhered in the drying unit.

6. The recording apparatus according to claim 1, wherein the contact surface of the contact member is formed by a smoothing process.

7. The recording apparatus according to claim 1, wherein the contact member has a U-shape.

8. The recording apparatus according to claim 1, wherein the contact member is elongate along the transport path.

9. The recording apparatus according to claim 1, wherein the recording medium enters and exits the drying unit intermittently through a first wall of the drying unit through, respectively, an entry opening and an exit opening, the entry opening and the exit opening being formed in the first wall and separated by an air discharge opening in the first wall.

10. The recording apparatus according to claim 1, wherein the contact member being mounted to the first wall and reinforced along an elongate length of the contact member from the first wall, into a space of the drying unit, and returning to the first wall to prevent distortion and deformation to the contact member from a force applied by the recording material to the contact member in a direction toward the first wall.

* * * * *